US005766055A

United States Patent [19]

Kim et al.

[11] Patent Number: 5,766,055

[45] Date of Patent: Jun. 16, 1998

[54] MODEL GLIDER HAVING POSITION-VARIABLE WINGS

[76] Inventors: Cho-kwon Kim, 115-338 Munwon-dong, Kwachon-shi, Kyunggi-do, Rep. of Korea, 427 090; Kang-hee Hahn, 2-203 Sangil Useong Town,174 Sangil-dong, Kangdong-gu, Seoul, Rep. of Korea, 134-090

[21] Appl. No.: 741,940

[22] Filed: Oct. 31, 1996

[30] Foreign Application Priority Data

Oct. 31, 1995 [KR] Rep. of Korea ..... 95-31825
Oct. 18, 1996 [KR] Rep. of Korea ..... 96-34374

[51] Int. Cl.[6] ..... A63H 27/00

[52] U.S. Cl. ..... 446/62; 446/66; 244/46

[58] Field of Search ..... 446/61, 62, 66, 446/68; 244/46

[56] References Cited

U.S. PATENT DOCUMENTS

| | | | |
|---|---|---|---|
| 2,074,897 | 3/1937 | Everts | 446/62 |
| 2,744,698 | 5/1956 | Baynes | 244/46 |
| 3,426,983 | 2/1969 | Deplant | 244/46 |
| 3,490,720 | 1/1970 | Girard | 244/46 |
| 4,915,664 | 4/1990 | Bakker | 446/66 |

FOREIGN PATENT DOCUMENTS

| | | | |
|---|---|---|---|
| 421076 | 8/1946 | Italy | 446/62 |
| 2227950 | 8/1990 | United Kingdom | 446/62 |

*Primary Examiner*—Robert A. Hafer
*Assistant Examiner*—Laura Fossum

[57] ABSTRACT

The present invention relates to a model glider having position-variable wings wherein the installation angle of the main wings of the model glider can be freely adjusted within a certain limit by a user, thus providing optimum flight. The model glider according to the present invention includes a central frame constituting a central body of the model glider, auxiliary frames connected with the central frame on both sides of the central frame, a vertical tail mounted upward on the rear part of the central frame, horizontal tails mounted horizontally on both sides of the rear part of the auxiliary frames, main wings movably mounted on the auxiliary frames and connected to the central frame via the auxiliary frames, and an angle adjusting means to adjust the angle between the main wings and the central frame.

4 Claims, 4 Drawing Sheets

MODEL GLIDER HAVING POSITION-VARIABLE WINGS

BACKGROUND

1. The Field of the Invention

The present invention relates to a model glider having position-variable wings, and in particular to a model glider having position-variable wings wherein the installation angle of the main wings of the model glider can be freely adjusted within a certain limit by a user, thus providing optimum flight.

2. The Background Art

A glider is an aircraft like an airplane except that it has no engine and is carried along by air currents. These days, model gliders are widely used as model planes and miniature toys for the purpose of education and play.

The model gliders are distributed and sold in the market in an assembled or disassembled state, and in the latter case the user puts the parts of the model glider together and completes the whole model glider.

The conventional model glider comprises a central frame constituting the body of the model glider, a vertical tail mounted upward on the rear part of the central frame, horizontal tails extended from both side ends of the central frame, and main horizontal wings extended from both sides in the middle parts of the central frame.

The glider may further comprise auxiliary frames, coupled with the central frame to be partially superimposed with the main wings, connecting the main wings to the central frame.

The auxiliary frames are symmetrically fitted onto the both sides of the central frame.

As is generally known, the main horizontal wings are to lift the whole body of the model glider and to control the movement of the body of the model glider right and left. The horizontal tails are to control the movement of the body up and down, and the vertical tail is to determine the right and left progressive directions of the body.

The model glider can fly by the action of the lift by means of the main wings which are located substantially at the center of gravity of the model glider. The flying of the model glider is determined by the angle between the central frame and the main wings and whether the center of the lift is consistent with the center of gravity of the central frame.

When the center of gravity of the central frame is in accord with the center of the lift, the model glider begins to fly by the external propulsive force and flies stably a long way off, descending gradually.

However, when the center of gravity is before the center of the lift and the front part of the model glider is heavy, the model glider descends abruptly and lands in a short time. Then, the flight is not satisfactory.

Also, when the center of gravity is behind the center of the lift and the front part of the model glider is light, the model glider instantaneously flies with a rising curve. However, since the lasting propulsive force does not act on the model glider, the model glider falls on the ground forming a steep curve instantaneously.

The angle between the main horizontal wings and the central frame affects the resisting force and the flying speed of the model glider.

In case of conventional model gliders, the main wings are integrally manufactured with the central frame, or in assembly model gliders the main wings are manufactured separately and sticked to the central frame by adhesives.

Particularly, in an assembly model glider, it is common that the center of gravity of the central frame is not consistent with the center of the lift, and accordingly the flying speed and the flying distance covered in a given time were not satisfactory.

The conventional model gliders reduce users' interest since they cannot provide various shapes of flight which are varied depending on air currents, climate and users' tastes.

BRIEF SUMMARY AND OBJECTS OF THE INVENTION

It is therefore an object of the present invention to provide a model glider having position-variable wings in which the position of main wings can be freely adjusted by a user, thus providing optimum flight.

It is another object of the present invention to provide a model glider which encourages children and students to study autonomously and actively the principle of flight, and which enhances the interest of the students and educational effect.

Those objects of the present invention can be achieved by the model glider having position-variable wings which comprises a central frame constituting a central body of the model glider, auxiliary frames connected with the central frame on both sides of the central frame, a vertical tail mounted upward on the rear part of the central frame, horizontal tails mounted horizontally on both sides of the rear part of the auxiliary frames, main wings movably mounted on the auxiliary frames and connected to the central frame via the auxiliary frames, and an angle adjusting means to adjust the angle between the main wings and the central frame.

According to the present invention, when the center of gravity is not in accord with the center of the lift in an assembly model glider, the center of the lift can be freely adjusted to be consistent with the center of gravity by means of the angle adjusting means, enabling optimum flight of the model glider.

Further, with the model glider according to the present invention, various shapes of flight can be obtained according to the varied angles of the main wings with respect to the central frame, and an active study of the flying principle can be achieved.

BRIEF DESCRIPTION OF THE DRAWINGS

The present invention will be described in more detail by way of example with reference to the accompanying drawings, in which.

DETAILED DESCRIPTION OF THE PREFERRED EMBODIMENTS

Figure 1:
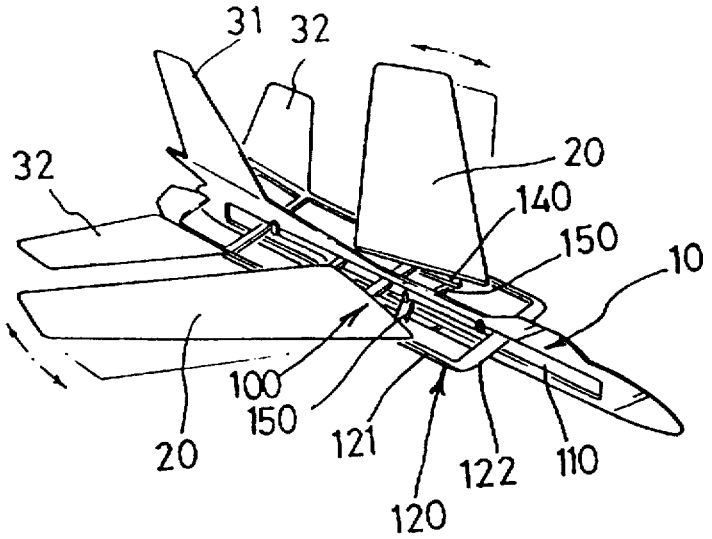
FIG. 1 is a perspective view of the model glider having position-variable wings according to the present invention.
Figure 2:
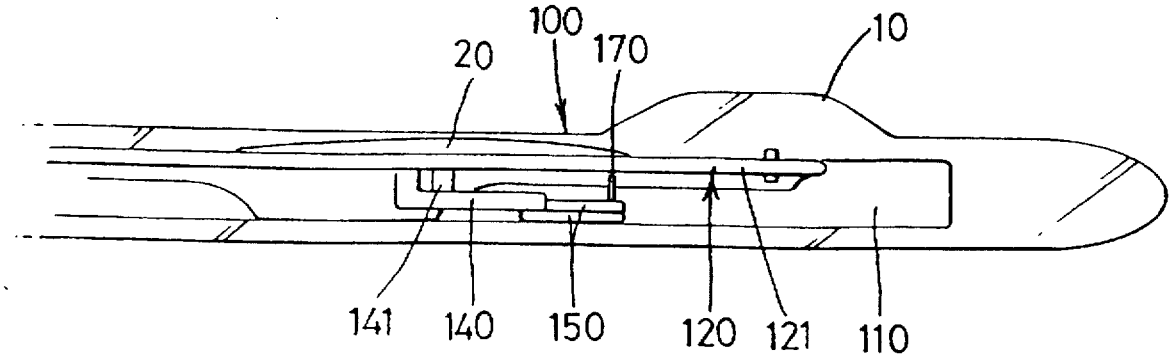
FIG. 2 is a partial side view showing principal parts of the model glider according to the present invention.

As shown in FIG. 1, a central frame 10 is fitted with auxiliary frames 20 on its both side parts. A vertical tail 31 is mounted upward on the rear part of the central frame 10. Main wings 20 are mounted horizontally on the approximate middle parts of the both sides of the auxiliary frames 20 and two horizontal tails 32 are symmetrically mounted on the both sides of the rear part of the auxiliary frames 20.

The central frame 10 constitutes a central body of the model glider and is formed of thin plate member in accordance with the profile of an airplane. It is preferable that the central frame 10 is made of wood having a comparatively low specific gravity and excellent plasticity, or synthetic resins having excellent injection molding property.

Figure 3:
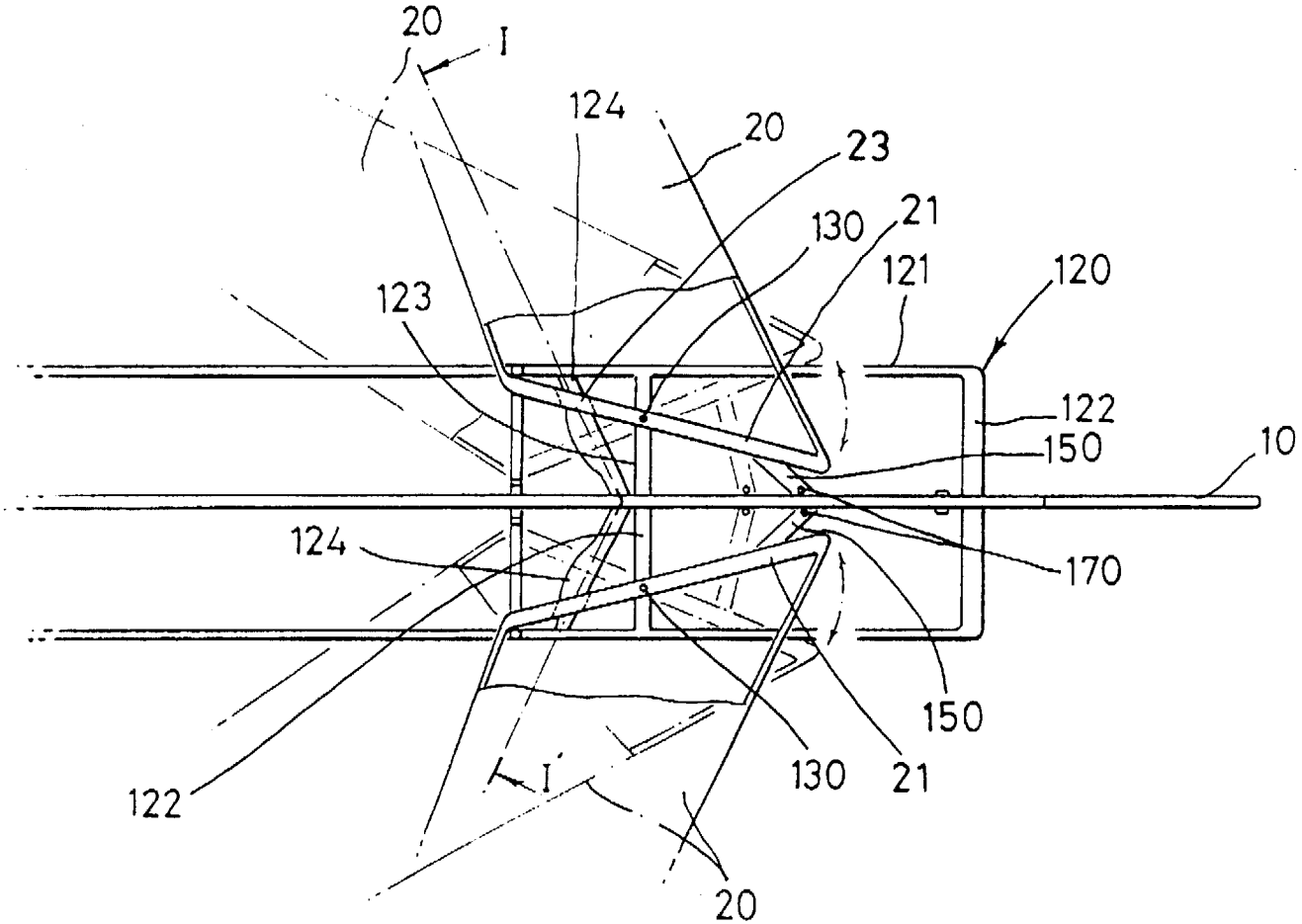
FIG. 3 is a partial plane view showing the angle adjustment of the main wings with respect to the central frame according to the present invention.

The auxiliary frames 120 are integrally fixed or movably connected to the both sides of the central frame 10. As shown in FIGS. 1 and 3, the auxiliary frames 120 comprise elongated members 121 extending lengthwise and horizontal members 122 connecting the elongated members 121 breadthwise and have substantially rectangular form.

The auxiliary frames 120 may be fixed adhesively to the both side walls of the central frame 10. Also, the auxiliary frames 120 may be formed in one body passing through an opening 110 which is formed by cutting the middle part of the central frame 10 longitudinally from its front part to its rear part. That is, the two auxiliary frames 120 are mutually connected by means of one or more connecting members 127, where the two auxiliary frames 120 and the connecting members 127 form a channel to receive the central frame 10 therein. The distance between the two auxiliary frames 120 is complementary with the thickness of the central frame 10. The upper part of the opening 110 of the central frame 10 is inserted into the channel of the auxiliary frame 120. Then, the auxiliary frames 120 move lengthwise along the upper part of the opening 110 of the central frame 10, thus enabling free adjustment of the angle of the main wings 20 with respect to the central frame 10.

In this case, means to prevent the auxiliary frame 120 from being released from the central frame 10 and moving freely up and down is required.

Figure 5:
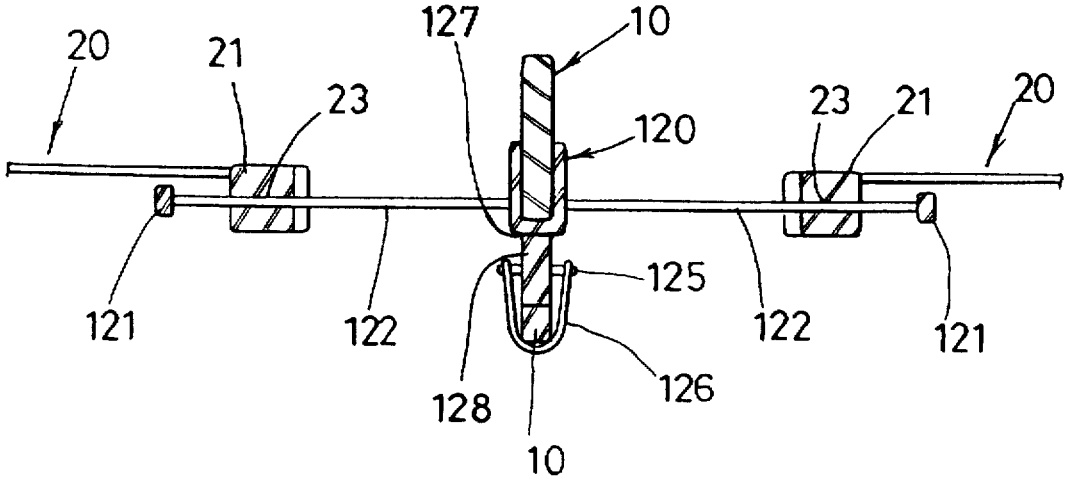
FIG. 5 is a sectional view of the model glider taken along a line I—I of FIG. 3.

Accordingly, as shown in FIG. 5, a protruding part 128 is extended from the connecting member 127 to reach the lower part of the opening 110 of the central frame 10, and a fixing bar 125 horizontally penetrates the protruding part 128.

On the both end parts of the fixing bar 125, an elastic string 126 is hung elastically via the lowest outside part of the central frame 10. Thus, by the movement of the auxiliary frames 120 connected integrally with each other with respect to the central frame 10, users can adjust the positions of the main wings 20 and the horizontal tails 32 so that the center of the lift may be consistent with the center of gravity of the central frame 10.

Meanwhile, a vertical tail 31 is mounted upward on the rear part of the central frame 10 and determines the right and left progressive directions of the model glider.

A pair of horizontal tails 32 are symmetrically mounted extending from the both external sides of the auxiliary frames 120 and control up and down movement of the model glider in flying.

The main wings 20 symmetrically mounted on the auxiliary frames 120 lift the whole body of the model glider and maintain the whole body in the air.

Flying speed and the lift are varied according to the angle of the main wings 20 with respect to the central frame 10.

The main wings 20 as well as the vertical and horizontal tails 31 and 32 may be respectively covered with thin sheet members. The central and auxiliary frames, tails and wings are preferably formed of wood having low specific gravity or synthetic resins having excellent injection molding property. The sheet members are preferably made of paper or vinyl, and paper is more preferable.

The most distinguishing property of the model glider according to the present invention is that the model glider includes an angle adjusting means 100 which enables a user to freely adjust the angle of the main wings 20 with respect to the central frame 10.

Figure 4:
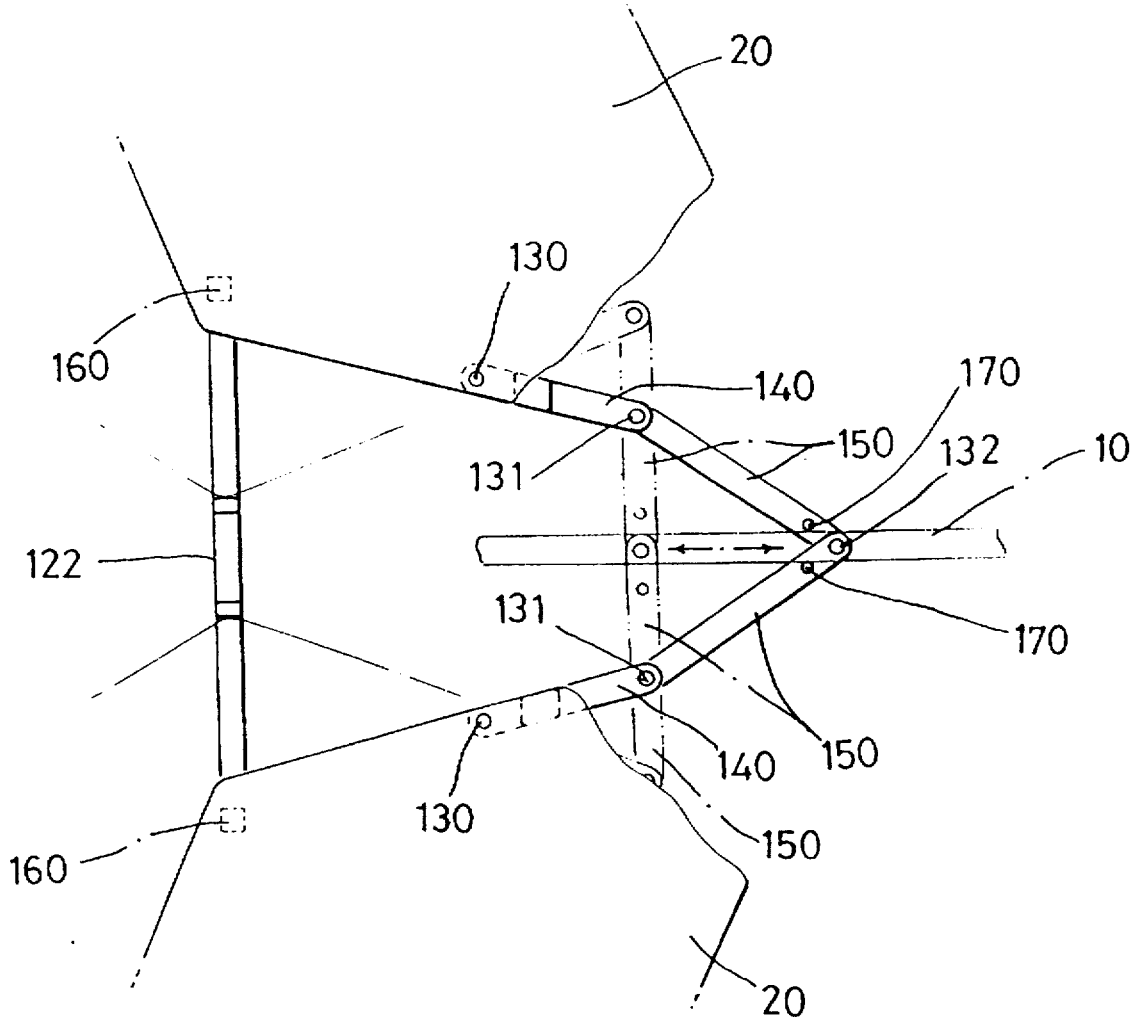
FIG. 4 shows the angle adjusting means of the present invention.

FIGS. 1, 3 and 4 show an embodiment of the angle adjusting means 100. In those Figures, the main wings 20 are partially superimposed on the auxiliary frames 120. Each of the main wings 20 may pivot centering around each pin 130 fixed at a predetermined intersection of frame members 21 of the main wings 20 and connecting members 123 crossing the auxiliary frames breadthwise. The frame members 21 are to be internal sides of the main wings 10 enabling the main wings 10 to be connected with the auxiliary frames 120.

FIGS. 3 and 4 show the symmetrical adjustment of the main wings 20 in detail. A first pair of links 140 are provided between the frame members 21 and the central frame 10. One end of one first link 140 is connected to the frame member 21 by the pin 130 and the other end is connected with one end of a second link 150 by a first hinge pin 131, of which the other end is connected with one end of the other second link 150 by a second hinge pin 132 below the upper part of the opening 110 of the central frame 10.

In the same manner, the other end of the other second link 150 is connected to one end of the other first link 140 by the other first hinge pin 131, and the other end of the other first link 140 is connected to the other frame member 21 by the other pin 130.

The installation angle of the main wings 20 is symmetrically adjustable with the above structure.

When the second links 150 are moved to the left of FIG. 4 (shown in assumed lines) by removing the second hinge pin 132, the links 150 form a straight line and, in accordance with the movement of the second and the first hinge pins 132 and 131, a pair of the main wings 20 pivot centering around their respective pins 130. Then, the angle between the two main wings 20 decreases.

On the contrary, when it is necessary to increase the angle between the two main wings 20, the links 150 are removed to the right of FIG. 4 along the line of the central frame 10 and then the main wings 20 pivot centering around their respective pins 130. The maximum angle between the main wings 20 is restrained by stoppers 160 protruded from the respective auxiliary frames 120.

A pair of guide pins 170 can be mounted on the second links 150 contacting with the side walls of the central frame 10 to guide the movement of the links 150 along the line of the central frame 10.

When the angle of the main wings 20 with respect to the central frame 10 is adjusted by means of the angle adjusting means 100, a fixing means may be further provided to maintain the adjusted angle. Accordingly, a pair of guide members 124 are provided between the respective external elongated members 121 of the auxiliary frames 120 and the respective internal elongated members 121, and the frame members 21 of the main wings 20 have guide holes 23 through which the guide members 124 respectively pass. The height of the guide holes 23 is complementary with the thickness of the guide members 124 so that the main wings 20 may not be removed freely along the guide member 124, thus maintaining the adjusted angle as described above constant.

According to the present invention, the main wings of the model glider are freely removable to adjust the angle of the main wings to the central frame, thus enabling the center of the lift to be consistent with the center of gravity of the model glider. According to the present invention, children and students may learn a lot of flying principle and states varied by the movement of the main wings.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed and desired to be secured by United States Letters patent is:

1. A model glider having position-variable wings, the model glider comprising:

a central frame constituting a central body of the model glider, said central frame having a first side and a second side;

a first auxiliary frame and a second auxiliary frame, wherein each of said auxiliary frames comprises an internal elongated member and an external elongated member connected at their ends by two horizontal members to form an essentially rectangular framework and at their mid-regions by a connecting member that extends across said frame from said internal elongated member to said external elongated member, wherein said internal elongated member of said first auxiliary frame is connected with said first side of said central frame wherein said internal elongated member of said second auxiliary frame is connected with said second side of said central frame, and wherein each said auxiliary frame is held in fixed angular relation with said central frame;

a vertical tail mounted so that it projects vertically upward on the rear part of said central frame;

a first horizontal tail and a second horizontal tail, wherein said first horizontal tail is mounted horizontally on the rear part of said external elongated member of said first auxiliary frame and wherein said second horizontal tail is mounted horizontally on the rear part of said external elongated member of said second auxiliary frame;

a first main wing and a second main wing, wherein each of said first and second main wings includes a frame member at its internal side, wherein said first main wing is movably mounted on said first auxiliary frame and wherein said second main wing is movably mounted on said second auxiliary frame; and an angle adjusting mechanism associated with each of said main wings comprising a pin which passes through said connecting member of said auxiliary frame and through said frame member of said main wing, whereby each of said main wings pivots with respect to its auxiliary frame, centering around its respective pin, whereby the angle between each of said main wings and the auxiliary frame to which it is mounted can be adjusted between flights of said model glider by a person using said model glider, but does not vary while said model glider is in flight.

2. A model glider as claimed in claim 1, wherein said first and second auxiliary frames are connected to said central frame and to each other by at least one connecting member, said connecting member having a channel, wherein said first and second auxiliary frames are connected to either side of each said connecting member having a channel, wherein said central frame includes an internal opening having an upper edge, and wherein said upper edge of said internal opening of said central frame fits securely into said channel in said connecting member.

3. A model glider as claimed in claim 1, wherein each of said auxiliary frames further comprises a guide member running from said external elongated member to said internal elongated members, wherein said frame members of said main wings have guide holes through which said guide members respectively pass, whereby the size of said guide members approximate the size of said guide members sufficiently closely that a friction fit is obtained whereby the position of said wings with respect to said auxiliary frames can be adjusted when force is applied by a person using said glider, but will not vary during flight of said glider.

4. A model glider as claimed in claim 1, wherein on each side of said central frame, a first and second link, each link having a first end and a second end, are provided between said frame member of said main wing and said central frame, wherein said first end of said first link is connected to said frame member of said main wing by means of a first hinge pin and said second end of said first link is connected to said first end of said second link, and wherein said second end of said second link is connected with said second end of the corresponding second link on the other side of said central frame by a second hinge pin, and wherein said second end of each said second link on either side of said central frame is provided with a guide pin which extends along the side of said central frame and which maintains said second hinge pin in position on said central frame while allowing it to slide along said central frame, thereby allowing symmetrical adjustment of the position of said main wings.

* * * * *